United States Patent [19]

Souders

[11] Patent Number: 5,009,333

[45] Date of Patent: Apr. 23, 1991

[54] JEWELRY HOLDER KIT

[76] Inventor: Karen Souders, 449 Colgate Ave., Elyria, Ohio 44035

[21] Appl. No.: 411,664

[22] Filed: Sep. 25, 1989

Related U.S. Application Data

[63] Continuation-in-part of Ser. No. 255,489, Oct. 8, 1988, Pat. No. 4,907,704.

[51] Int. Cl.[5] ..... A47F 7/00

[52] U.S. Cl. ..... 211/13; 211/89

[58] Field of Search ..... 211/13, 89, 60.1, 70.6; 206/486, 566

[56] References Cited

U.S. PATENT DOCUMENTS

| | | | |
|---|---|---|---|
| 191,647 | 4/1960 | Seeger | 211/13 X |
| 734,962 | 7/1903 | Royer . | |
| 2,058,340 | 10/1936 | Miller . | |
| 2,605,032 | 7/1952 | Hunt et al. . | |
| 2,861,682 | 11/1958 | Hatcher . | |
| 3,344,967 | 10/1967 | Kelly . | |
| 3,473,991 | 10/1969 | Ludwig . | |
| 3,718,260 | 2/1973 | Sharp | 211/13 |
| 3,783,995 | 1/1974 | Tobin | 211/113 |
| 3,845,861 | 11/1974 | Fieri . | |
| 3,933,286 | 1/1976 | Karkas . | |
| 4,099,611 | 7/1978 | Fiebelman . | |
| 4,287,986 | 9/1981 | Beck . | |
| 4,721,644 | 1/1988 | Mayo | 211/87 X |
| 4,767,011 | 8/1988 | Butler | 211/60.1 X |

*Primary Examiner*—Carl D. Friedman
*Assistant Examiner*—Sarah A. Lechok

[57] ABSTRACT

The invention is a jewelry holder kit and process for its use. The kit comprises: a stock pad consisting essentially of resilient foamed polymer readily penetrable by and having depth sufficient for retaining a penetrating part of the object to be held thereon and exhibiting a self-healing working surface exposing a multitude of open cells, the working surface being at least partially faced or faceable with discontinuous paint; paint for applying the at least partial facing on the working surface to the extent that it has not been preapplied; and at least one pattern of a configuration that fits the pad for shaping and/or decorating at least a portion of the working surface thereof.

20 Claims, 1 Drawing Sheet

JEWELRY HOLDER KIT

REFERENCE OF RELATED APPLICATIONS

This application is a continuation-in-part of my copending application Ser. No. 07/255,489, filed on Oct. 8, 1988, and entitled Jewelry Holder. The teachings of that application are incorporated herein by reference.

TECHNICAL FIELD

This invention relates to a kit for making a holder for storage and/or display of articles such as jewelry or the like, and more particularly to a kit for making such holder of a pad or cushion type.

BACKGROUND ART

Some jewelry display boards and pin cushions are relevant art here. Thus, the abutting, fabric-wrapped, resilient foamed plastic bars of U.S. Pat. No. 2,861,682 were designed to hold jewelry between the bars and display it: the pin cushion kit of U.S. Pat. No. 3,344,967 uses a hemispherical foamed polystyrene ball; and the framed jewelry display/storage/carrying device of U.S. Pat. No. 4,181,224 has a pair of perforated plastic sheet layers overlaying a filler material that can be foamed or fibrous. The hairpin-holding bracelets of U.S. Pat. Nos. 2,058,340 and 3,473,991 use partly exposed sponge rubber pads, as does the paperweight-pincushion of U.S. Pat. No. 734,962. The sueded vinyl-covered bulletin board of U.S. Pat. No. 4,721,644 is excellent for push pins.

The present kit for holding objects such as jewelry and the like is subject to far fewer constraints as to shape and decoration than are previously-proposed jewelry holders. It can be produced very economically. It is easily decorated in a variety of ways. It has the peculiar virtue of having basically a working surface that is able to endure the punitive marks of service, that is the disfiguring and destructive penetrations of ear ring posts, retainers or locks, pins, etc., quite effectively while still maintaining an attractive appearance. This is particularly the case with the penetration of ear ring posts that have on them, for convenience, their small removable back-locking members. Thus, the instant holder can be considered a specialty for holding those ear rings that are made for pierced ear lobes. The usually tiny back locks need not be stored separately and, thereby, become subject to being mislaid, lost, or damaged.

BROAD STATEMENT OF THE INVENTION

The instant kit comprises: a stock pad consisting essentially of resilient foamed polymer readily penetrable by and having depth sufficient for retaining a penetrating part of the object to be held thereon and exhibiting a self-healing working surface that exposes a multitude of open cells, the working surface having an at least partial facing of discontinuous paint or being at least partially faceable therewith; paint for said at least partial facing to the extent that a discontinuous paint facing or partial facing has not been preapplied thereto; and at least one pattern with a configuration that fits the confines of the pad for shaping and/or decorating at least a portion thereof.

DEFINITIONS

A "polymer" here means a polyurethane, a natural or synthetic rubber, a polyolefin, or the like. It can be solidly colored, multicolored (polychrome), flecked speckled, mottled or neutral in color, which often is a white or an off-white.

A "resilient foamed polymer" is one having closed cell or interconnecting cell construction. Its density preferably will be between about 1 and 12 pounds per cubic foot and that can be even higher, e.g., 15. It can be made fire retardant. Generally the more rapidly the foam recovers from a surface deformation, as from the punch of the eraser end of a pencil, the better. However, even a slow, gradual, substantially complete recovery indicates adequate resiliency because recovery time is rarely of significance for the present uses. Pore diameter advantageously is up to about a millimeter in diameter, and it can be more; it need not be uniform It usually is desirable, however, to have an appreciable fraction of these exposed open cells which are of about the diameter of the penetrating post or pin. One or more pads consisting essentially of the polymer can be provided in a kit. The pads, if desired, can have an internal stiffening member such as a board or a reinforcing frame, or a stiff backing such as glued-on cardboard.

"Self-healing" means the property of self-closing up of small punctures automatically and substantially restoring of surface level in a reasonable time. Preferably there ensues in a fairly short time the substantial disappearance of these punctures to the casual glance from an unaided eye.

"Contractive filaments" are fine, flexible threads that stress the foam surface. They can help close small punctures therein and possibly limit permanent surface disruption. These filaments generally are embedded in the top surface or are otherwise adherent to it. They can be a gauzy open mesh, a scrim, a light non-woven fabric, or a plurality of filaments lying mainly if not entirely in one direction, if desired. The filaments can be somewhat elastic because of their twist and/or their composition, such as some polyamides, but they do not have to be so to be effective in promoting self-healing of the surface when they adhere to it.

"Discontinuous paint" means an incomplete covering or coating of paint, enamel, varnish, lacquer, ink, cured deposits of powder paint, stain, wash, pigmentary solid, wax crayon, or like colorant on the working surface, or even flecks, specks, or mottlings and other variegations built right into the working surface of the stock foam pad, suitably made with a polymerizable or polymerized material. It can be monochromatic or polychromatic, and partly or entirely in the configuration of a fanciful design or indicia, emblem, insignia, banner, or seal, etc. spread over all or over a substantial portion, e.g., preferably at least nominally (i.e., ignoring any tiny discontinuities) about a tenth to a quarter of the working surface. A preferred paint for broad or background coverage is an aqueous compounded latex paint, particularly one containing some polyvinyl alcohol and applied as a very light deposit over a thin, dried layer of aqueous borax solution or other solution of a water soluble salt as set forth in U.S. Pat. No. 3,218,191. Flatness, i.e., low or no gloss, is desirable in a broad paint deposit here. Spraying, particularly with a stencil, is a preferred way of applying paint to provide a background color on and/or to decorate the pad. The discontinuous paint need not contain a binder that wets the pad surface if only temporary coverage is desired in certain surface zones.

A "pattern" here means a template, pattern, stencil, mask, outline, or matrix that one can use to shape the pad and/or apply decorations to it. A single pattern can be laid over the pad to trim the pad into the shape of, say, a stylized heart or other fanciful object; the same pattern can be perforated, if desired, to provide a stencil for coloring through the perforations onto the pad surface, eg. with a paint, wax crayon, chalk, pigmentary powders, etc. A kit can have a plurality of patterns in it for choosing amongst, and have two or more patterns of configurations that together are adapted to the confines of the pad (i.e., they fit on the pad together, eg. to be used separately from each other to make a plurality of holders or to shape and/or decorate a single pad. A kit can have a single or a plurality of pads to decorate and/or to shape.

BEST MODE FOR CARRYING OUT THE INVENTION

Figure 1:
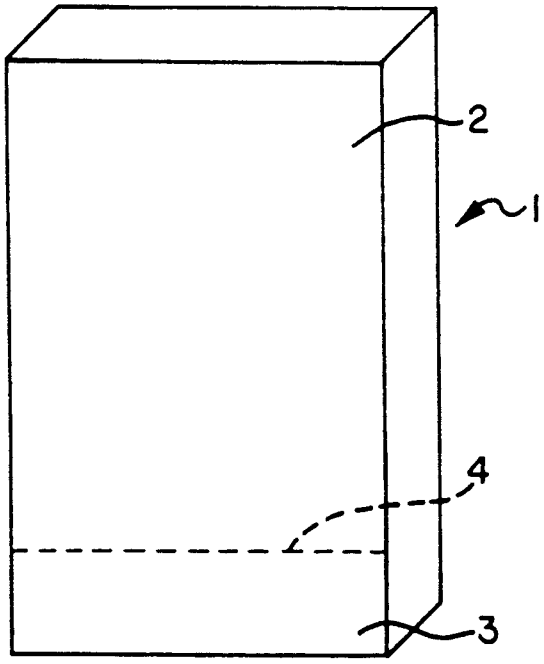
FIG. 1 is an isometric view of a 12"×10" stock pad consisting essentially of resilient foamed polymer stock about ⅜" thick and spray painted lightly with flat paint to yield a pair of discontinuous colored films on its front (working) surface. A pad to be further shaped and/or decorated can be characterized as a "stock pad."

Referring to FIG. 1, arrow 1 indicates generally the block-like stock pad with the discontinuous paint on its working (front) surface. Surface 2 is a flat green, surface 3 a flat brown. The division between these colors is generally along the line 4 indicated as a dotted line. Adhering to the face of the pad, but not shown in FIG. 1, is a light gauzy filament about 3/32" mesh. The foam is a fine-celled, high density polyurethane. Its working surface for accepting jewelry is mostly exposed cells, at least about a quarter of which are about 1/32"-3/64" in diameter. These constitute the largest cells or pores in the working surface, and many are smaller. The surface optically is quite grainy. The foam is of a type often used for protective padding, orthopaedic soft goods, and furniture The discontinuous paint coating over the face of the block-like pad hits most heavily on high spots but, when viewed straight on, gives the whole "foliage" surface a generally green look and the rest below that a brown look.

Figure 2:
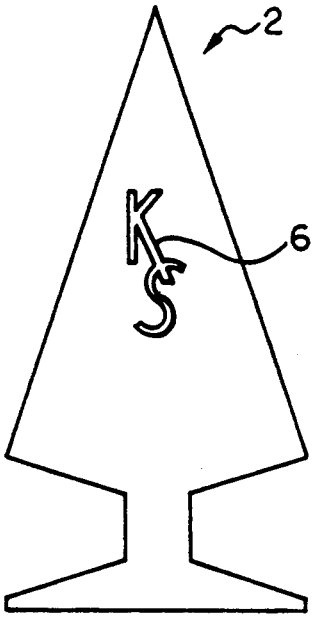
FIG. 2 shows a stylized pine tree pattern. It is of thin, stiff cardboard perforated with the initials "CS" to be a stencil for those letters as well as to provide an outline for the tree on the rectangular pad.

Arrow 2 of FIG. 2 indicates generally the stylized tree pattern with the monogram stencil 6 perforated through it. The pattern 2 is laid over the face 2 (front) of the block-like stock pad. It just fits. The pad then is sheared to the tree outline. The "tree" is the "shaped pad" here. The trunk and base are brown, the foliage green. The resulting "tree" then is stencilled with gilt paint through stencil 6 of pattern 2. A cardboard backing (not shown in FIG. 2) can be glued onto the rear of the "tree" before or after shaping the block-like pad. Also, after shearing, an edging (not shown) of pressure-sensitive colored tape, eg. gold, can be stuck around the edges of the "tree" for further decoration, and the tree can even be lightly flecked with a spatter of gold paint.

Figure 3:
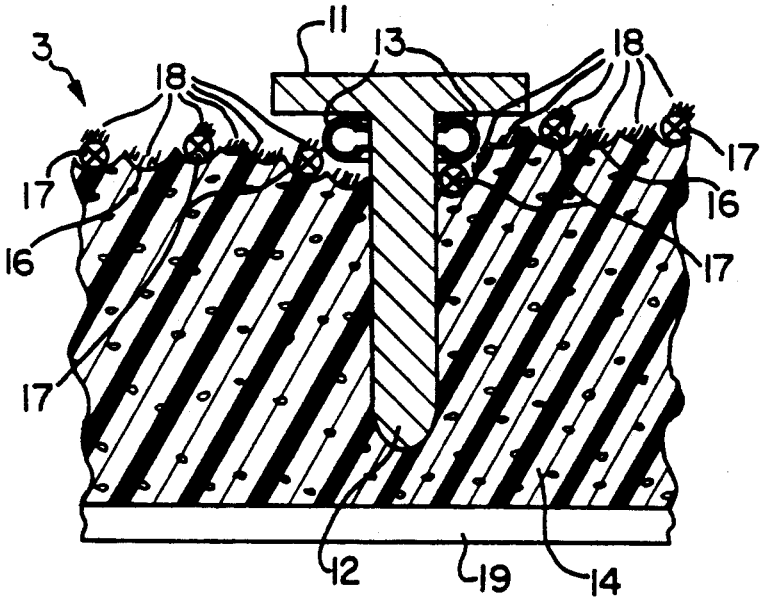
FIG. 3 is an enlarged fragmentary cross section (taken just below the "KS" letters) directly through the thickness of a jewelry holder made from the pad of FIG. 1 and the pattern of FIG. 2. The holder has a stiff cardboard backing adherent thereto and shows an earring stuck into the portion shown.

Referring to FIG. 3, an earring for pierced ear lobes, having a top 11, a post 12, and a removable back-locking member 13 around the post is held in the green-surfaced part of foam pad 14 just below the monogram. The upper surface of the open (cut) foam cells is represented by a series of small upwardly-looking cusps 16. The tiny "x"-centered circles 17 in the cusps represent the tiny filaments running almost invisibly in one direction in the overlying mesh fabric and intersecting like transverse filaments that are not seen in this view. The small irregular deposits 18 in and around the cusps and on some of the filaments are to represent the discontinuous paint. Backing 19 is glued onto the bottom of the foam pad 14.

When an earring and its back lock are withdrawn for wear, the resulting puncture and depression in the working surface of the pad (i.e., the wound) quickly closes and gradually levels out. The resiliency of the foam, aided by the filament overlay, mechanically pulls together for appreciable obliteration of the wound. This obliteration also is assisted substantially by the discontinuity of the paint; some of this effect from the paint may be mechanical, some optical. The flatness of the paint appears to assist somewhat also, and this is optical. The net effect is to make the surface appear substantially unaffected over an extended period of puncturings and earring storage periods. The mesh, additionally, may restrict or minimize disintegration of the foam structure. It is a definite asset for the holder, as is the benefit from the discontinuous paint.

The holder can be made with a self-propping member in the rear like many portrait frames, and the foam pad can be framed, if desired. The pad, or a frame or like structure around the pad, can be fitted with hooks, holes, gripper surfaces or the like to suspend the holder if that is wanted.

The possible designs formed by or drawn on the face or faces of the instant holder are limitless, as are the colors that can be used. Thus, the designs can include a written message, surface contour as well as edge contour, a map, a person or animal or a part thereof such as a visage, a fraternal emblem, seal, or banner, a cartoon character, one or a bunch of flowers, etc.

The discontinuous paint need not cover all or even a major portion of the working surface to be helpful Thus, such paint can be variegated. spotted-on, dotted-on, spattered-on, etc. to give that surface a variegated, spotted, dotted, sprinkled, speckled, flecked, freckled, blotched, mottled, stippled, patchy, flaked, splashed or spattered effect.

The kit also can include, if desired, a backing member such as a piece of stiff cardboard or other board-like material and a web of contractive filaments if backing and such web are not already affixed to the foam pad. Other optional kit items include an edge-binding material such as tape, and adhesive to join it and/or a backing and/or such web to the pad, or to join pads together to form a polygon or the like (if such optional item is not already equipped with a pressure-sensitive adhesive). Because some polymers and foams are attached by various organic solvents, selection of fluent adhesives and paint generally is best left to the manufacturer of the kit rather than to the purchaser.

A further optional kit item is one or more paints or colorants for decorating the pad. Suitably this is a material yielding a flat finish and one capable of making readily a discontinuous facing on the working surface. Small spray cans of the paint are preferred made easily with brushes or rollers and liquid or be made easily with brushes or rollers and liquid or paste-type colorants.

Many other modifications and variations of the invention will be apparent to those skilled in the art in the light of the foregoing disclosure and drawings. Therefore, it is to be understood that, within the scope of the appended claims, the invention can be practiced otherwise than has been specifically shown and described.

I claim:

1. A kit for making a holder for an object such as jewelry or the like which has a pin-like penetrating part and a shorter protrusion on one side, the kit comprising:

a stock pad consisting essentially of resilient foamed polymer, the pad having a self-healing working surface that exposes a multitude of open cells and has an at least partial facing of discontinuous paint on said working surface, said open cells and discontinuous paint being for the purpose of assisting to obliterate puncture marks from service, the pad having sufficient depth for gripping and retaining the penetrating part of the object to be held, the working surface being readily penetrable by the penetrating part and depressible by the shorter protrusion for the purpose of accepting said penetrating part that is to be gripped and retained by the foamed polymer; and at least one pattern of configuration adapted to the confines of the pad for decorating and/or shaping it.

2. The kit of claim 1 which includes an openwork web of contractive filaments for overlaying attachment to at least a portion of the working surface.

3. The kit of claim 2 wherein said web is attached to or embedded into the working surface.

4. The kit of claim 1 which includes a stiffener for the pad.

5. The kit of claim 4 wherein the stiffener is a backing that is attached to or is attachable to the pad.

6. The kit of claim 1 wherein the discontinuous paint on the working surface includes a design and/or indicia.

7. The kit of claim 1 wherein the pad itself and/or the pattern is of fanciful design.

8. The kit of claim 1 which includes support or suspension means for the finished holder.

9. The kit of claim 1 wherein the discontinuous paint exhibits a flat finish, and at least nominally about 10% of the working surface is faced therewith.

10. The kit of claim 1 which includes a plurality of patterns, at least a pair of which fit within the boundaries of the pad.

11. The kit of claim 1 wherein at least one of the patterns includes a stencil for coloring exposed portions of the pad and masking other exposed portions

12. The kit of claim 1 wherein at least one of the patterns is that for making a fanciful shape of the pad.

13. The kit of claim 1 which includes at least one discrete package of paint for application to the pad.

14. A kit for making a holder for an object such as jewelry or the like which has a pin-like penetrating part and a shorter protrusion on one side, the kit comprising:

a stock pad consisting essentially of resilient foamed polymer, the pad having a self-healing working surface that exposes a multitude of open cells and is at least partially faced or faceable with discontinuous paint on said working surface, a purpose of said open cells and the discontinuous paint being to assist in the obliteration of puncture marks from service, the pad having sufficient depth for gripping and retaining the penetrating part of the object to be held, the working surface being readily penetrable by the penetrating part and depressible by the shorter protrusion for the purpose of accepting said penetrating part that is to be gripped and retained by the foamed polymer;

paint for applying the at least partial facing on the working surface to the extent that a discontinuous paint facing or partial facing has not been preapplied thereto; and at least one pattern of configuration adapted to the confines of the pad for decorating and/or shaping it.

15. The kit of claim 14 wherein there is an openwork web of contractive filaments attached to or embedded into the working surface of the pad.

16. The kit of claim 14 which includes a stiffening member that is attachable to the pad, is attached thereto, or is internal thereto.

17. The kit of claim 14 wherein discontinuous paint has been preapplied in the form that comprises a design and/or indicia.

18. The kit of claim 14 wherein the pad is of a fanciful shape and the pattern is of a fanciful design therefor.

19. The kit of claim 14 wherein there are a plurality of patterns and/or a plurality of pads.

20. A process for making a holder for jewelry having a pin-like penetrating part and a shorter protrusion on one side from a kit which contains:

a stock pad consisting essentially of foamed polymer that has a self-healing working surface which exposes a multitude of open cells and is at least partially faced or faceable with discontinuous paint on said working surface, the purpose of the open cells and the discontinuous paint being to assist in the obliteration of puncture marks from service, the pad having sufficient depth for gripping and retaining the penetrating part of the object to be held, the working surface being readily penetrable by the penetrating part;

paint for applying to the at least partial facing on the working surface to the extent that a discontinuous paint facing or at least partial facing has not been preapplied thereto; and at least one pattern of configuration adapted to the confines of the stock pad for decorating and/or shaping it, the process comprising:

superimposing a pattern on the stock pad, and shaping the stock pad in accordance with at least one feature of the pattern, thereby making a shaped pad, and/or applying decoration to the stock pad with the aid of the pattern, and/or applying decoration to the shaped pad with the aid of the pattern.

* * * * *